US010389061B2

(12) United States Patent
McDowell et al.

(10) Patent No.: US 10,389,061 B2
(45) Date of Patent: Aug. 20, 2019

(54) ELECTRICAL CONNECTOR HAVING A REAR SEAL AND A REAR-LOADED COVER/RETAINER MEMBER

(71) Applicant: TE Connectivity Corporation, Berwyn, PA (US)

(72) Inventors: Paul W. McDowell, Fishers, IN (US); Chong Hun Yi, Mechanicsburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/816,642

(22) Filed: Nov. 17, 2017

(65) Prior Publication Data

US 2019/0157797 A1 May 23, 2019

(51) Int. Cl.

| | |
|---|---|
| ***H01R 9/05*** | (2006.01) |
| ***H01R 13/52*** | (2006.01) |
| ***H01R 13/58*** | (2006.01) |
| ***H01R 13/506*** | (2006.01) |
| ***H01R 13/436*** | (2006.01) |

(52) U.S. Cl.

CPC ..... *H01R 13/5208* (2013.01); *H01R 13/4367* (2013.01); *H01R 13/506* (2013.01); *H01R 13/5825* (2013.01)

(58) Field of Classification Search

CPC ..... H01R 13/52; H01R 13/5205; H01R 13/5221; H91R 13/5202

USPC ..... 439/587, 271

See application file for complete search history.

(56) References Cited

U.S. PATENT DOCUMENTS

| | | | | |
|---|---|---|---|---|
| 5,017,162 A | | 5/1991 | Krehbiel et al. | |
| 5,632,653 A | * | 5/1997 | Sawada ..... | H01R 13/5208 439/279 |
| 5,766,039 A | | 6/1998 | Abe | |

(Continued)

FOREIGN PATENT DOCUMENTS

| | | | |
|---|---|---|---|
| FR | 2872636 | A1 | 1/2006 |
| JP | 2001015204 | A | 1/2001 |
| JP | 2004342415 | A | 12/2004 |

OTHER PUBLICATIONS

MOLEX Application Specification, ML-XT™ Sealed Connector System, 13 pgs, Aug. 25, 2017.

(Continued)

*Primary Examiner* — Phuong K Dinh

(57) ABSTRACT

An electrical connector with a wire seal member. The wire seal member has seal member openings which extend through the seal member. Recesses are provided proximate the seal member openings and extend about the circumference of the seal member openings, the recesses extend from a first surface of the seal member in a direction toward a second surface. A rear-loaded cover/retainer is positioned proximate the wire seal member. The cover/retainer has cover/retainer openings, the cover/retainer openings are positioned to align with the seal member openings. The cover/retainer openings have projections which are positioned about the circumference of the cover/retainer openings. Wherein as the projections of the cover/retainer are moved into the recesses of the wire seal member, the projections enter the recesses and cause the seal member openings to interact with and seal the wire conductors.

16 Claims, 5 Drawing Sheets

(56) References Cited

U.S. PATENT DOCUMENTS

| | | | | |
|---|---|---|---|---|
| 6,045,404 | A | 4/2000 | Myer | |
| 6,514,098 | B2 | 2/2003 | Marpoe, Jr. et al. | |
| 6,527,586 | B2 * | 3/2003 | Okamura | H01R 13/5208 439/587 |
| 6,572,586 | B1 * | 6/2003 | Wojcik | A61M 5/158 128/DIG. 6 |
| 7,273,395 | B2 * | 9/2007 | Hayashi | H01R 13/506 439/587 |
| 8,408,950 | B2 | 4/2013 | Jeon et al. | |

OTHER PUBLICATIONS

MOLEX 2CCTML-XT CV Connector, Product Customer Drawing, 9 pgs. Jan. 3, 2017.

International Search Report and Written Opinion issued for corresponding PCT Application PCT/IB2018/058630 dated Jan. 8, 2019.

* cited by examiner

ELECTRICAL CONNECTOR HAVING A REAR SEAL AND A REAR-LOADED COVER/RETAINER MEMBER

FIELD OF THE INVENTION

The present invention is directed to an electrical connector having a rear seal and a rear-loaded cover/retainer. In particular, the invention is directed to a rear seal which cooperates with the cover/retainer to compress the seal against wire insulation of the wires inserted into the electrical connector.

BACKGROUND OF THE INVENTION

Preventing shorting of the electrical connectors in environments where moisture and other contaminants are present is important. Interface seals between connectors are often easy to manufacture and install and are often effective in controlling the ingress of moisture. To the contrary, wire seals provided at the wire receiving end of the connectors are often expensive to manufacture and difficult to install. Many of the wire seals are damaged or are deformed during assembly, causing the wire seal to leak, rendering the connector seal and the electrical connector ineffective.

It would, therefore, be beneficial to provide a wire seal connector which can be easily manufacture and installed. It would also be beneficial to provide a wire seal in which the effects of damage or deformation are minimized, resulting in an effective seal being made and maintained.

SUMMARY OF THE INVENTION

An embodiment is directed to an electrical connector having electrical terminals/contacts with wire conductors attached thereto. The electrical connector includes a housing having a mating connector receiving face and a wire receiving face. The housing has terminal receiving circuit cavities which extend from the mating connector receiving face to the wire receiving face. A wire seal member is positioned in the housing proximate the wire receiving face. The wire seal member has seal member openings which extend through the seal member, the seal member openings align with the terminal receiving circuit cavities. Recesses are provided proximate the seal member openings and extend about the circumference of the wire seal member openings, the recesses extend from a first surface of the seal member in a direction toward a second surface. A rear-loaded cover/retainer is positioned proximate the wire receiving face of the housing and proximate the wire seal member. The cover/retainer has a first surface which faces wire receiving face of the housing and a second surface which faces away from the housing. Cover/retainer openings are positioned in and extend through the cover/retainer, the cover/retainer openings are positioned to align with the terminal receiving cavities of the housing and the seal member openings. The cover/retainer openings have projections which are positioned about the circumference of the cover/retainer openings. The projections extend from the first surface in a direction toward the housing. Wherein as the projections of the cover/retainer are moved into the recesses of the wire seal member, the projections enter the recesses and cause the seal member openings to interact with and seal the wire conductors.

An embodiment is directed to an electrical connector having electrical terminals/contacts with wire conductors attached thereto. The electrical connector includes a housing having a wire receiving face. The housing has terminal receiving cavities which extend from the wire receiving face. A wire seal member is positioned in the housing proximate the wire receiving face, the wire seal member has seal member openings which extend through the seal member. The seal member openings align with the terminal/contact receiving cavities. Recesses are provided proximate the seal member openings. A cover/retainer is positioned proximate the wire receiving face of the housing and proximate the wire seal member. Cover/retainer openings are positioned in and extend through the cover/retainer. The cover/retainer openings are positioned to align with the terminal receiving cavities of the housing and the seal member openings. The cover/retainer openings have projections which are positioned about the circumference of the cover/retainer openings. Wherein the projections of the cover/retainer are made of stiff or rigid material in comparison to the more compliant or softer material of the wire seal member, wherein as the projections of the cover/retainer are moved into the recesses of the wire seal member, the projections force the more compliant or softer material around the openings of the wire seal member to interact with and seal the wire conductors.

An embodiment is directed to a method of sealing the wire conductors of an electrical connector which extend from a wire receiving surface of the electrical connector. The method includes: inserting the wire conductors with terminal/contact attached thereto into cover/retainer openings of a cover/retainer, seal openings of a rear seal member and a terminal/contact receiving circuit cavity of a housing; moving the cover/retainer from a pre-loaded position; engaging stiff or rigid projections of the cover/retainer with recess in compliant material of the wire seal member; moving the compliant material around the openings of the rear seal member to interact with and seal the wire conductors; and positioning the cover/retainer in a fully inserted position.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Figure 1:
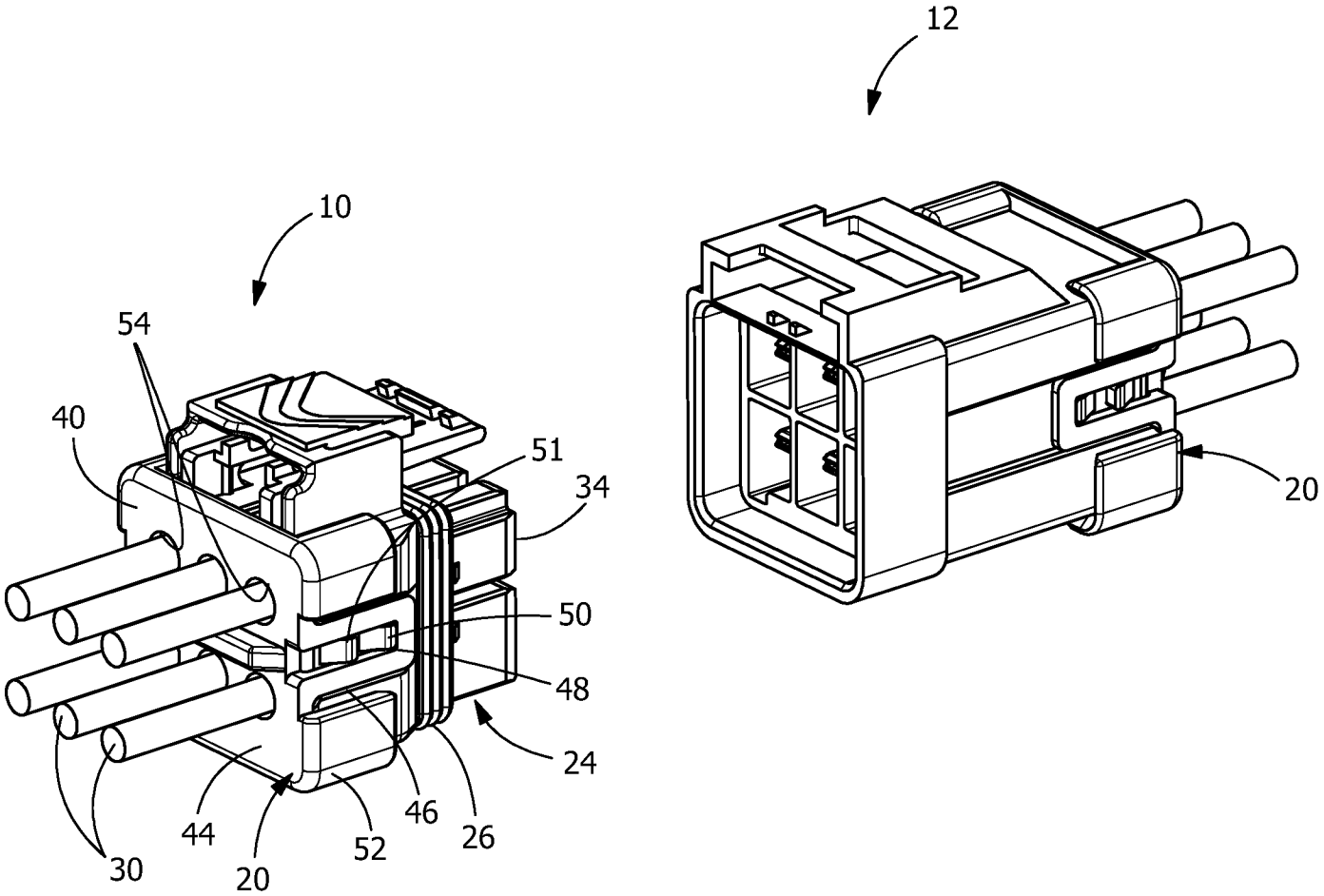
FIG. 1 is a perspective view of sealed male connector and a sealed female connector prior to mating.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features, the scope of the invention being defined by the claims appended hereto.

In the illustrative embodiment shown in FIG. 1, a sealed rear-loaded male electrical connector 10 is shown in position to be mated to a sealed rear-loaded female electrical connector 12. The sealed rear-loaded male electrical connector 10 and the sealed rear-loaded female electrical connector 12 each include a rear-loaded cover/retainer 20 and a wire seal member 22 (see FIG. 2). As the rear-loaded cover/retainer 20 and the wire seal member 22 are similar for both the sealed rear-loaded male electrical connector 10 and the sealed rear-loaded female electrical connector 12, only the sealed rear-loaded male electrical connector 10 will be described in detail.

Figure 2:
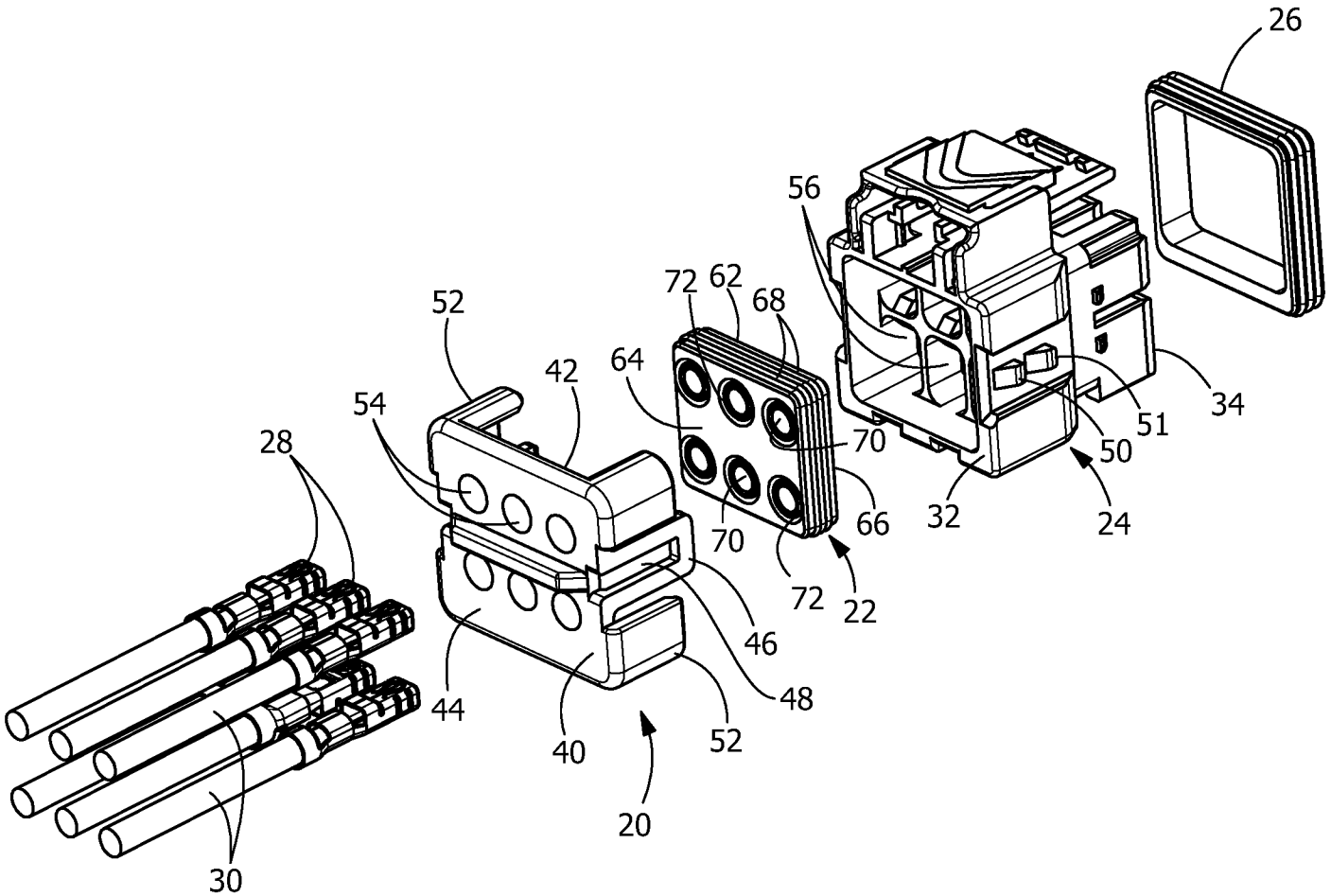
FIG. 2 is an exploded perspective view of the male connector of FIG. 1, taken from the wire receiving face.
Figure 3:
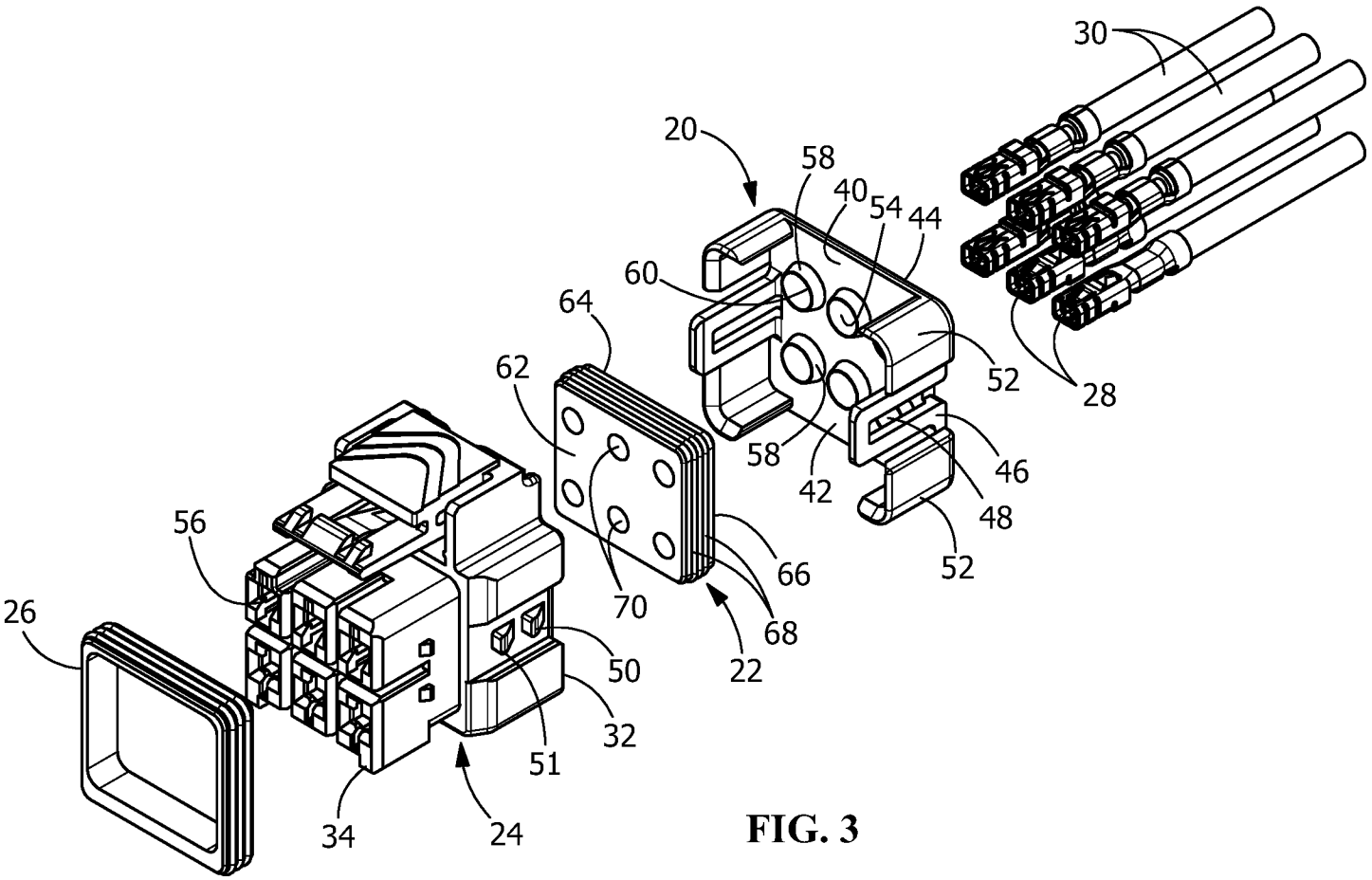
FIG. 3 is an exploded perspective view of the male connector of FIG. 1, taken from the mating receiving face.

As best shown in FIGS. 2 and 3, in the illustrative embodiment, the electrical connector 10 includes the rear-loaded wire seal cover/retainer 20, the wire seal member 22, a housing 24, a front seal 26 and terminals 28. The terminals 28 are terminate to conductors or wires 30 using known methods. For example, in the embodiment shown the terminals/contacts 28 are crimped to the wires 30. The terminals are inserted into the housing through a wire receiving face 32 of the housing 24 and extend toward a mating connector receiving surface 34.

The rear-loaded wire seal cover/retainer 20 is positioned proximate to and in cooperation with the wire receiving face 32 of the housing 24. The rear-loaded cover/retainer 20 includes a wall 40 having a first surface 42 which faces the wire receiving face 32 of the housing 24 and the wire seal member 22, and a second surface 44 which faces away from the housing 24. The cover/retainer 20 may be formed of any suitable material having the stiffness and rigidity required, including, but not limited to, injection molded materials, including, but not limited to, polyamides, polybutylene terephthalates, liquid-crystal polymers or combinations thereof.

Latching arms 46 extend from opposite ends of the wall 40 and extend from the wall 40 in a direction toward the housing 24. The latching arms 46 extend from the wall 40 at approximately 90-degree angles. The latching arms 46 have openings or slots 48 which cooperate with latching projections 50, 51 of the housing 24.

Positioning members 52 may be optionally provided. Positioning members 52 extend from the corners of the wall 40 in a direction toward the housing 24. The positioning members 52 extend from the wall 40 at approximately 90-degree angles. Other configurations of the latching arms 46 and the positioning members 52 may be used without departing from the scope of the invention. The positioning members 52 cooperate with the housing 24 to properly orient and position the wire seal cover/retainer 20 relative to the housing 24.

Figure 5:
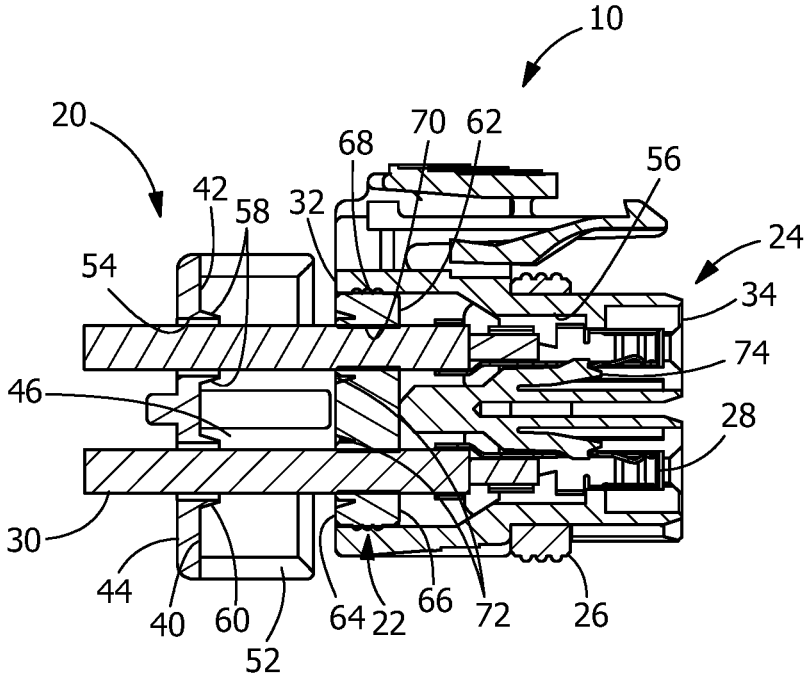
FIG. 5 is a cross-section view of the male connector with a cover/retainer in a pre-loaded position.
Figure 6:
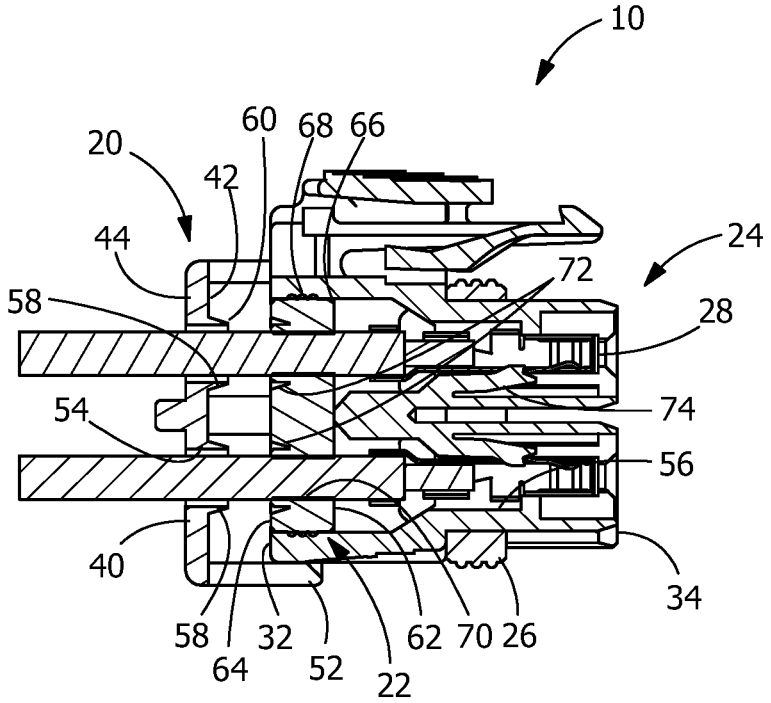
FIG. 6 is a cross-section view of the male connector with the cover/retainer in a partially inserted position.
Figure 7:
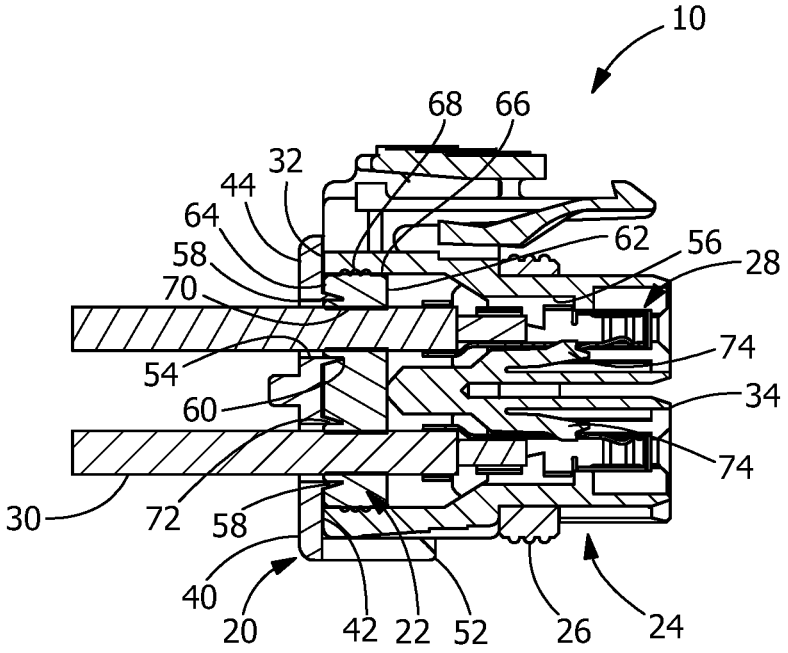
FIG. 7 is a cross-section view of the male connector with the cover/retainer in a fully inserted position.

Cover/retainer openings 54 are positioned in and extend through the wall 40. The openings 54 are positioned to align with terminal receiving cavities 56 of the housing 24. The openings 54 are configured to receive the terminals 28 and wires 30 therein. As best shown in FIGS. 3 and 5 through 7, the openings 54 have projections or walls 58 which are positioned about the circumference of the openings 54. The projections or walls 58 extend from the first surface 42 of the wall 40 in a direction toward the housing 24. As best shown in FIGS. 5 through 7, the projections or walls 58 have a conical type configuration, whereby the thickness of the projections or walls 58 proximate the first surface 42 is greater than the thickness of the projections or walls 58 proximate the free ends 60 of the projections or walls 58 which are spaced from the first surface 42. This provides the projections or walls 58 with a triangular cross-section, as shown in FIGS. 5 through 7.

Figure 4:
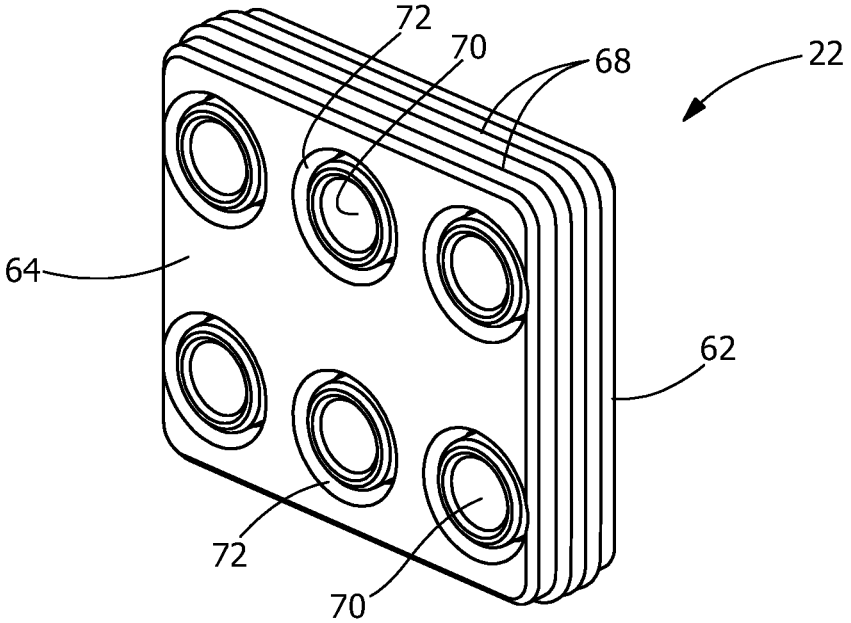
FIG. 4 is an enlarged perspective view of a wire seal member of the present invention.

The wire seal member 22, as best shown in FIG. 4, may be formed of any suitable material having the properties required to prevent moisture or other contaminants, such as, but not limited to, insulating foam, from entering the terminal receiving cavities 56 from the rear of the connector 10 and allow the movement of the material, as will be more fully described. Such materials include, but are not limited to, silicone rubbers, inherently lubricated silicone rubbers, fluorosilicon rubbers, or combinations thereof. The seal member 22 is positioned in the housing proximate the wire receiving face 32. The seal member 22 has a first surface 62 which faces the housing 24 and a second surface 64 which faces away from the housing 24 and toward the rear-loaded wire seal cover/retainer 20. Side walls 66 extend between the first surface 62 and the second surface 64. The side walls 66 have one or more ribs 68 which extend about the periphery and cooperate with the housing 24 to facilitate the sealing between the wire seal member 22 and the housing 24.

Seal member openings 70 are positioned in and extend through the seal member 22. The openings 70 are positioned to align with terminal receiving cavities 56 of the housing 24 and the openings 54 of the wire seal cover/retainer 20. The openings 70 are configured to receive the terminals/contacts 28 and wires 30 therein. As best shown in FIGS. 2 and 4 through 7, recesses 72 are provided proximate the openings 70 and extend about the circumference of the openings 70. The recesses 72 extend from the second surface 64 of the wire seal member 22 in a direction toward the first surface 62. As best shown in FIGS. 5 through 7, the recesses 72 have a conical type configuration, whereby the spacing between the side walls of the recesses 72 proximate the second surface 64 is greater than spacing between the side walls of the recesses 72 proximate the ends of the recesses 72 which are spaced from the second surface 64. This provides the recesses 72 with a triangular cross-section, as shown in FIGS. 5 through 7.

During assembly, the wire seal member 22 is positioned in the housing, as shown in FIG. 5. In the embodiment shown, the front interfacial seal 26 is also positioned on the housing 24 at this stage. However, the front interfacial seal 26 may be positioned on the housing 24 at any time during assembly. The wire seal cover/retainer 20 is then positioned on the housing 24 in an initial pre-loaded or initial position. In this position, first latching projections 50 are positioned in the openings or slots 48 of the latching arms 46. Portions of the latching arms 46 are positioned between the first latching projections 50 and the second latching projections 51 to maintain the cover/retainer 20 in the pre-loaded position.

With the connector 10 in the pre-loaded position, the terminals 28 and conductors or wires 30 are inserted through the openings 54 of the wire seal cover/retainer 20, through the openings 70 of the rear seal member 22 and into the terminal receive cavities 56 of the housing 24. When the terminals 28 are fully inserted, terminal retaining features 74 of the housing 24 engage the terminals/contacts 28 to retain the terminals/contacts 28 in the terminal receive circuit cavities 56.

In many applications, the terminals/contacts 28 have a larger profile than the profile of the conductors or wires 30. In addition, the terminals/contacts 28 often have protruding or sharp features and corners. However, as the openings 70 of the wire seal member 22 are dimensioned to be placed in sealing engagement with the conductors 30, the diameter of the openings must be properly controlled. Consequently, with existing wire seals, as the terminals/contacts 28 are inserted through the openings 70 of the wire seal member 22, the terminals 28 may cause damage to the wire seal member 22 at the openings 70, for example by tearing the material around the openings 70 or by stretching the material around the openings 70. This can result in damage to the rear seal member, causing the seal to leak, rendering the rear seal member ineffective.

In contrast, the combination of the wire seal 22 and the wire seal cover/retainer 20 provide for a more effective sealing arrangement. Although the terminals 28 are inserted as described in the preceding paragraph, the present invention still provides effective sealing as the wire seal cover/retainer 20 provides additional support to the rear seal 22. As shown in FIG. 6, as the cover/retainer 20 is moved from the pre-loaded position (FIG. 5) to the fully inserted position (FIG. 7), the projections or walls 58 of the wire seal cover/retainer 20 enter the recesses 72 of the wire seal member 22. As the wire seal cover/retainer 20 is moved from the pre-loaded position to the fully inserted position, the projections or walls 58 of the wire seal cover/retainer 20 are fully positioned in the recesses 72 of the wire seal member 22.

As the projections or walls 58 of the wire seal cover/retainer 20 are made of stiff or rigid material, the projections or walls 58 of the wire seal cover/retainer 20 have not been deformed by the insertion of the terminals/contacts 28 therethrough, allowing the projections or walls 58 of the wire seal cover/retainer 20 to retain their original shape. Consequently, as the projections or walls 58 of the wire seal cover/retainer 20 are moved into or enter the recesses 72 of the wire seal member 22, the projections or walls 58 of the cover/retainer 20 force the more compliant or softer material around the openings 70 of the wire seal member 22 to move back to their original shape. This allows the openings 70, even if some material deformation has occurred during the insertion of the terminals 28, to interact with or properly conform to the diameter of the conductors or wires 30, thereby providing an effective seal at the rear of the connector 10.

As shown in FIG. 7, the wire seal cover/retainer 20 is retained in the fully inserted position by the positioning of the second first latching projections 51 in the openings or slots 48 of the latching arms 46. In this position, the projections or walls 58 of the cover/retainer 20 are maintained in the recesses 72 of the rear seal member 22, thereby maintaining a proper seal at the rear of the connector 10.

As the projections or walls 58 of the wire seal cover/retainer 20 are maintained in the recesses 72 of the wire seal member 22 when the connector 10 is fully assembled, the cooperation of the cover/retainer 20 and the wire seal member 22 provides strain relief to the conductors or wires 30. Because the wire seal cover/retainer 20 and the wire seal member 22 are tightly retained against the conductors or wires 30, any outside forces applied to the conductors or wires 30 will be absorbed by the wire seal member 22 and the wire seal cover/retainer 20 rather than being transferred to the terminals/contacts 28. In addition, as the wire seal cover/retainer 20 and the wire seal member 22 are tightly retained against the conductors or wires 30, the orientation of the conductors or wires 30 outside of the connector 10 will not affect the positioning or orientation of the terminals 28 in the housing 24, as rotational forces or stresses will be absorbed by the wire seal member 22 and by the wire seal cover/retainer 20.

In contrast to known seals which require the entire seal to be compressed to provide a proper seal, the present invention allows the material locally around the openings 70 of the wire seal member 22 to be manipulated or compressed by the projections or walls 58 of the wire seal cover/retainer 20. As the manipulation of the material is limited to small areas, the manipulation is much easier to control and easier to ensure proper results. Consequently, any damage to the wire seal member 22 caused by the insertion of the terminals/contacts 28 through the openings 70 will not adversely effect the seal, as the projections or walls 58 of the wire seal cover/retainer 20 will move the material of the rear seal member 22 into proper position to provide for a proper seal.

While the invention has been described with reference to a preferred embodiment, it will be understood by those skilled in the art that various changes may be made and equivalents may be substituted for elements thereof without departing from the spirit and scope of the invention as defined in the accompanying claims. In particular, it will be clear to those skilled in the art that the present invention may be embodied in other specific forms, structures, arrangements, proportions, sizes, and with other elements, materials and components, without departing from the spirit or essential characteristics thereof. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. An electrical connector having electrical terminals/contacts with wire conductors attached thereto, the electrical connector comprising:

a housing having a mating connector receiving face and a wire receiving face, the housing having terminal/contact receiving cavities which extend from the mating connector receiving face to the wire receiving face;

a wire seal member positioned in the housing proximate the wire receiving face, the wire seal member having seal member openings which extend through the seal member, the seal member openings align with the terminal/contact receiving cavities, recesses are provided proximate the wire seal member openings and extend about the circumference of the wire seal member openings, the recesses extend from a first surface of the seal member in a direction toward a second surface, the recesses have a conical configuration, wherein spacing between side walls of the recesses proximate the second surface of the wire seal member is greater than spacing between the side walls of the recesses proximate ends of the recesses which are spaced from the second surface of the wire seal member;

a rear-loaded cover/retainer positioned proximate the wire receiving face of the housing and proximate the wire seal member, the cover/retainer having a first surface which faces wire receiving face of the housing and a second surface which faces away from the housing, cover/retainer openings are positioned in and extend through the cover/retainer, the cover/retainer openings are positioned to align with the terminal/contact receiving cavities of the housing and the wire seal member openings, the cover/retainer openings have projections which are positioned about the circumference of the cover/retainer openings, the projections extend from the first surface in a direction toward the housing, the projections have a conical configuration, wherein a thickness of the projections proximate the first surface of the cover/retainer is greater than the thickness of the projections proximate free ends of the projections which are spaced from the first surface of the cover/retainer;

wherein as the projections of the wire seal cover/retainer are moved into the recesses of the wire seal member, the projections enter the recesses and cause the wire seal member openings to compress around the wire conductors.

2. The electrical connector as recited in claim 1, wherein the projections of the cover/retainer are made of stiff or rigid material in comparison to the more compliant or softer material of the wire seal member, wherein as the projections of the cover/retainer are moved into the recesses of the wire seal member, the projections force the more compliant or softer material around the openings of the wire seal member to interact with and seal the wire conductors.

3. The electrical connector as recited in claim 1, wherein a front seal is provided on the housing.

4. The electrical connector as recited in claim 1, wherein latching arms extend from opposite ends of the cover/retainer and extend in a direction toward the housing, the latching arms have openings which cooperate with latching projections of the housing.

5. The electrical connector as recited in claim 1, wherein positioning members extend from the corners of the cover/retainer in a direction toward the housing.

6. The electrical connector as recited in claim 1, wherein the wire seal member has side walls which extend between the first surface of the seal member and the second surface of the seal member, the side walls have one or more ribs which extend about the periphery of the wire seal member.

7. An electrical connector having electrical terminals with wire conductors attached thereto, the electrical connector comprising:

a housing having a wire receiving face, the housing having terminal receiving cavities which extend from the wire receiving face;

a wire seal member positioned in the housing proximate the wire receiving face, the wire seal member having seal member openings which extend through the seal member, the seal member openings align with the terminal receiving cavities, recesses are provided proximate the seal member openings, the recesses have a conical configuration, whereby spacing between side walls of the recesses proximate a second surface of the wire seal member is greater than spacing between the side walls of the recesses proximate ends of the recesses which are spaced from the second surface of the wire seal member;

a cover/retainer positioned proximate the wire receiving face of the housing and proximate the wire seal member, cover/retainer openings are positioned in and extend through the cover/retainer, the cover/retainer openings are positioned to align with the terminal receiving cavities of the housing and the seal member openings, the cover/retainer openings have projections which are positioned about the circumference of the cover/retainer openings, the projections have a conical configuration, whereby a thickness of the projections proximate a first surface of the cover/retainer is greater than the thickness of the projections proximate free ends of the projections which are spaced from the first surface of the cover/retainer;

wherein the projections of the cover/retainer are made of stiff or rigid material in comparison to the more compliant or softer material of the wire seal member, wherein as the projections of the cover/retainer are moved into the recesses of the wire seal member, the projections compress the more compliant or softer material around the openings of the wire seal member to seal the wire conductors and to provide cable strain relief to the wire conductors.

8. The electrical connector as recited in claim 7, wherein latching arms extend from opposite ends of the cover/retainer and extend in a direction toward the housing, the latching arms have openings which cooperate with latching projections of the housing.

9. The electrical connector as recited in claim 7, wherein positioning members extend from the corners of the cover/retainer in a direction toward the housing.

10. The electrical connector as recited in claim 7, wherein the wire seal member has side walls which extend between the first surface of the seal member and the second surface of the seal member, the side walls have one or more ribs which extend about the periphery of the wire seal member.

11. A method of sealing wire conductors of an electrical connector which extend from a wire receiving surface of the electrical connector, the method comprising:

inserting the wire conductors with terminal attached thereto into cover/retainer openings of a cover/retainer, seal openings of a rear seal member and a terminal receiving cavity of a housing;

moving the cover/retainer from a pre-loaded position;

engaging stiff or rigid projections of the cover/retainer with recess in compliant material of the rear seal member;

the stiff or rigid projections compressing the compliant material around the openings of the rear seal member to interact with and seal the wire conductors; and positioning the cover/retainer in a fully inserted position.

12. The method of claim 11, comprising:

latching the cover/retainer to the housing when the cover/retainer is in the fully inserted position.

13. The method of claim 11, wherein the recesses have a conical configuration, whereby spacing between side walls of the recesses proximate a second surface of the wire seal member which faces the cover/retainer is greater than spacing between the side walls of the recesses proximate ends of the recesses which are spaced from the second surface of the wire seal member.

14. The method of claim 11, wherein the projections have a conical configuration, whereby a thickness of the projections proximate a first surface of the cover/retainer which faces the rear seal member is greater than the thickness of the projections proximate free ends of the projections which are spaced from the first surface of the cover/retainer.

15. The electrical connector as recited in claim 11, wherein positioning members extend from corners of the cover/retainer in a direction toward the housing.

16. The electrical connector as recited in claim 13, wherein the rear seal member has side walls which extend between a first surface of the seal member and the second surface of the seal member, the side walls have one or more ribs which extend about the periphery of the wire seal member.

* * * * *